United States Patent [19]

Knight

[11] 3,981,353

[45] Sept. 21, 1976

[54] ANODE CASTING MACHINE

[76] Inventor: Bill J. Knight, 7315 S. Settler Ave., Tucson, Ariz. 85706

[22] Filed: Jan. 16, 1975

[21] Appl. No.: 532,491

[52] U.S. Cl. ..... 164/332; 164/336; 164/341; 164/343

[51] Int. Cl.[2] ..... B22D 19/00; B22D 41/04; B22D 17/26

[58] Field of Search ..... 164/332, 335, 336, 341, 164/342, 343, 348

[56] References Cited

UNITED STATES PATENTS

| | | | |
|---|---|---|---|
| 317,064 | 5/1885 | Wittenstrom | 164/348 X |
| 1,711,369 | 4/1929 | Wode | 164/332 X |
| 1,936,280 | 11/1933 | Williams | 164/348 X |
| 2,984,176 | 5/1961 | Sommer et al. | 164/341 UX |
| 3,199,159 | 8/1965 | Wernecke | 164/341 |
| 3,262,164 | 7/1966 | Meves | 164/341 |
| 3,465,387 | 9/1969 | Allard et al. | 164/343 X |
| 3,590,904 | 7/1971 | Woodburn, Jr. | 164/348 X |
| 3,659,644 | 5/1972 | DeBie | 164/348 X |
| 3,765,572 | 10/1973 | Neumann et al. | 164/336 X |

*Primary Examiner*—Ronald J. Shore
*Attorney, Agent, or Firm*—J. Michael McClanahan

[57] ABSTRACT

An anode casting machine for casting lead or lead alloy anodes used in copper electrowinning process comprising a pair of open face mold plates, means for uniting said mold plates, means for securing said mold plates in a liquid tight configuration about a hanger bar, ladle means for introducing lead or lead alloy into said mold, means for stabilizing mold temperature, means for separating said mold plates to facilitate removal of said anode, and means for transferring lead or lead alloy from a melting pot to said ladle means.

31 Claims, 8 Drawing Figures

ANODE CASTING MACHINE

BACKGROUND OF THE INVENTION

In copper electrowinning, a pure copper starter cathode sheet is immersed in a copper bearing liquid electrolyte together with a lead or lead alloy anode. Electrical current is passed between the anode and the cathode which deposits copper from the electrolyte onto the copper cathode starter sheet. As the copper bearing electrolyte is depleted, it is replenished. Ideally, there will be no transfer of the lead or lead alloy from the anode to the cathode by the passage of the current. As a practical matter, however, there is a transfer of small amounts of lead and/or lead alloy to the cathode. So long as the amount of lead or lead alloy passed is sufficiently low, the purity requirements of the deposited copper are met and there is no requirement that the copper cathode be put through an additional electrorefining process. The additional expense of electrorefining is apparent.

It has been ascertained that the lead or lead alloy anodes which perform most efficiently are anodes which present a smooth, dense, close-grained surface and which make good contact about the hanger bar to which they are attached, both mechanically and electrically.

In the past the lead or lead alloy anodes have been made from rolled plate which has been cut to size and to which the hanger bar has been attached by means for rivets. Additionally the anodes have been cast from lead or lead alloy, both for later mechanical connection to the hanger bar or cast about the hanger bar. Clearly cost factors dictate that if the desired characteristics can be obtained by casting then such should be the method employed. It is to this latter method to which the subject invention is directed.

SUMMARY OF THE INVENTION

The present invention comprises a machine for casting lead or lead alloy anodes having means for engaging open face mold plates in a vertical position, means introducing molten metal into the formed mold, means for temperature controlling the mold, means for disengaging the mold plates to permit removal of the cast anode and means for transferring lead or lead alloy to the casting machine from a melting pot.

The open face mold plates are primarily engaged by hydraulic pressure means and further secured by additional hydraulic pressure means in a liquid tight configuration about a hanger bar in the lower most end. The molten metal is permitted to enter the mold from an elevated ladle whereupon an air-water mixture is sprayed upon the mold exterior as needed to maintain a constant mold temperature. Upon solidification of the lead anode, the hydraulic mold securing means and engaging means are disengaged, the mold separated and the anode removed whereupon an additional air-water spray may be applied to the anode surfaces directly by the operator.

The lead or lead alloy is introduced into the ladle from the furnace or melting pot from the bottom of the melting pot by means of a transfer tube which extends below the molten metal surface.

Accordingly it is an object of the present invention to provide a machine to cast lead or lead alloy anodes for use in copper electrowinning.

It is also an object of the present invention to provide a lead or lead alloy cast about a hanger bar.

A further object of the present invention is to provide a machine to cast lead based anodes having characteristics of being dense and having a smooth close-grained surface.

DETAILED DESCRIPTION

Figure 1:
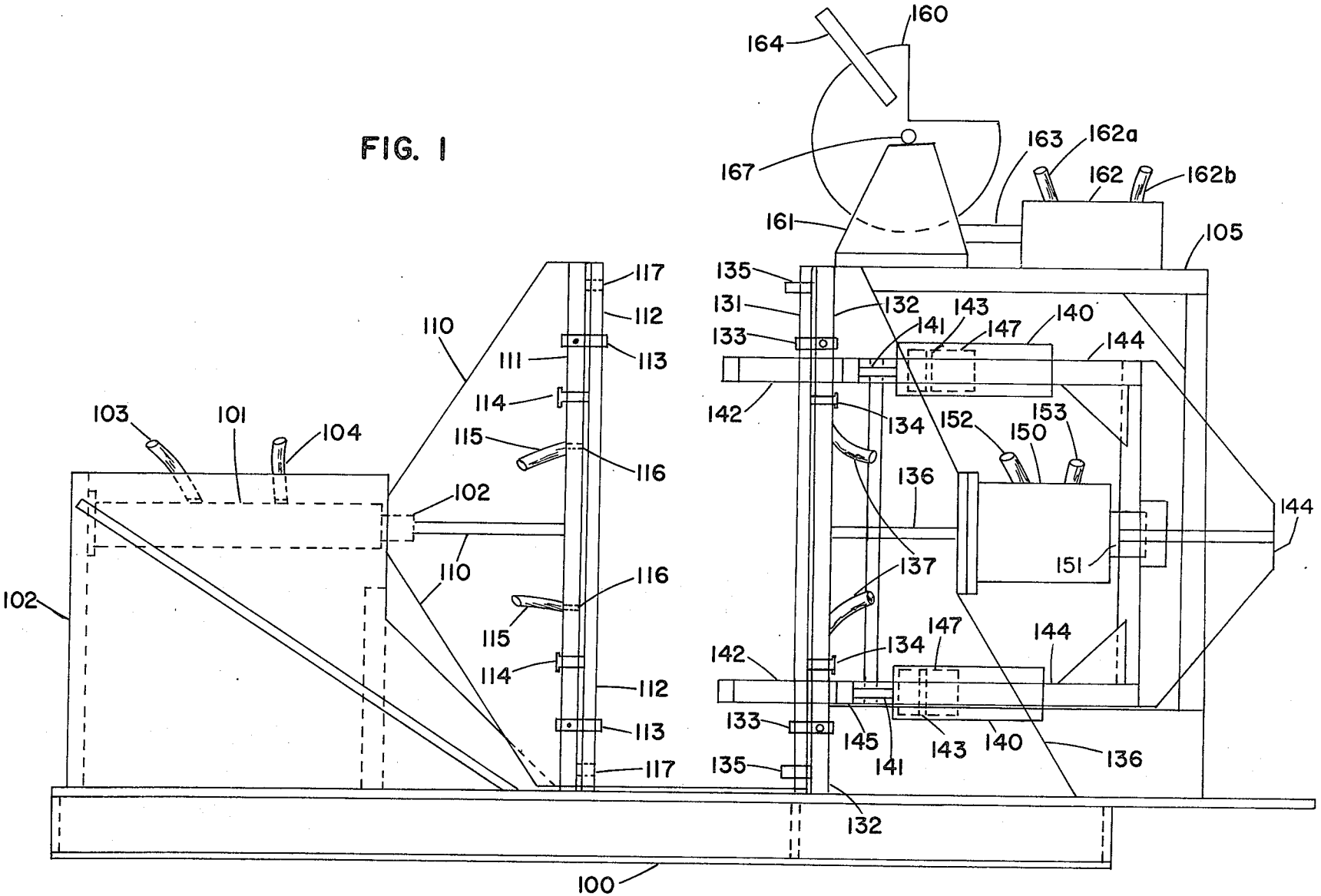
FIG. 1 is a side view of the casting machine incorporating the invention.

The embodiment of the invention shown in FIG. 1 comprises metal base platform 100 upon which the casting machine is secured. Based 100 is steel and typically made from a plurality of I-beams nominally four inches high and having a length of about eight feet. The base 100 is about four feet wide. Starting from left to right, hydraulic cylinder 101 which engages the mold plates, is attached to steel support means 102 which in turn is fastened to base 100.

Mold engaging cylinder 101 is double acting in which piston 102 may be forced out of cylinder 101 or drawn into the cylinder. Hydraulic fluid entrance means into cylinder 101 are through inlet hydraulic hose means 103 for forcing piston 102 out of the cylinder and inlet hydraulic hose means 104 for drawing piston 102 into the cylinder.

Piston 102 is attached to the apex of a plurality of metal strengthening webs 110 which originate at mold backing plate 111, the webs having a wheel hub-spoke like appearance. The strengthening webs 110 are welded to mold backing plate 111 to provide resistance to its warpage. Mold plate 112, which is the left hand open face half of the total mold is secured to mold backing plate 111 by means of L-shaped steel brackets 113 which press against the side and front of the mold plate 112 and are secured to the mold backing plate 111. Jack bolts 114, which are threaded through mold backing plate 111, press against the back of mold plate 112 to force the mold plate 112 face against the L-shaped brackets 113. The purpose of jack bolts 114 is two fold, one to hold mold plate 112 in place and second, to provide means to compensate for and adjust movement of mold plate 112 in order to provide a constant anode thickness. While there are only four L-shaped brackets 113, two on each side of the mold 112 and mold backing plate 111, there are a plurality of jack screws 114 equally spread upon the back side of mold 112. Thus the relative position of the mold face 112 at different points across the mold may be varied by adjustment of the various jack screws 114.

Typically, mold plate 112 is rectangular, about 3 feet by 5 feet high, and made from one inch thick steel plate having steel runners attached to the plate face outlining the shape of the anode, which steel runners mate with mirror image steel runners on the face of the mold plate on the opposite side.

Air hoses 115 attach to mold backing plate 111 at the side distal to mold plate 112 and by means of passage ways 116 through mold backing plate 111 permit an air-water mixture to be played against mold plate 112 as means for keeping the mold plate 112 temperature relatively constant during the casting of the anodes throughout the working day. There is a plurality of air-water mixture hoses 115 and passageways 116 spread across the surface of mold backing plate 111.

Alignment holes 117 are situated in the upper and lower corners of mold plate 112 which mate with alignment pins 135 of mold plate 131 infra.

Mold backing plate 111, to which is attached mold plate 112, is permitted to slide upon base 100 when mold engaging cylinder 101 and responding piston 102 is activated to mate the two halves of the mold to permit the casting operation.

Moving across to the stationary right hand portion of the casting machine, the other half of the mold, mold plate 131 is similarly attached to mold backing plate 132 by L-shaped brackets 133 which holds mold plate 131. Jack screws 134 are threaded through mold backing plate 132 and press upon the back of mold plate 131. Again there are only four L-shaped brackets 133, two on each side of the mold while there are a plurality of jack bolts 134. As a general rule jack bolts 134 are in substantially the same relative position with respect to the mold plate 131 as are jack bolts 114 to their respective mold plate 112 in the left hand portion of the casting machine.

Jack bolts 114 and 134 are adjusted when the mold plates 112 and 131 are in their engaged position in order to mold an anode which is of uniform thickness. Mold backing plate 132 is secured and held stationary to base standard 100.

It is noted that while mold backing plate 111 and mold backing plate 132 are at all times in alignment with respect to base 100, open face mold plates 112 and 113 are relatively free to move. It is noted that the L-shaped brackets 113 and 133 are attached to mold backing plates 111 and 132, they merely press against the mold plates 112 and 131. Alignment pins 135, attached to mold plates 131 mate with alignment holes 117 in mold plate 112. Thus, when the mold plates are mated together for the casting operation, both halves of the mold are free to move together as it expands and contracts upon its heating by the molten lead or lead alloy and subsequent cooling.

The two mold backing plates 111 and 132 forcing together mold plates 112 and 131 into a closed mold position are assisted by grappler arms 142 which swing out in an arc and come up behind mold backing plate 111 after the mold plates have been primarily engaged by piston 102 of mold engaging cylinder 101. Grappler arms 142 are actuated by means of hydraulic cylinders 140 and acting piston 141 attached to grappler arms 142 and grappler arm assembly 144 which when piston 141 is fully extended places L-shaped ends of grappler arms 142 behind mold backing plate 111. Piston 141 and hydraulic cylinder 140 are set off from grappler arm 142 and its pivot point 143 in order that the distal ends of grappler arm 142 swings in the aforedescribed arc.

Grappler arms 142 are utilized through their hydraulic means in time after the primary mold engaging piston 102 and cylinder 101 have forced the mold plates 112 and 131 together. Final securing of mold plate 112 to mold plate 131 to form the completed mold is accomplished by double acting hydraulic cylinder 150 which actuates piston 151 attached to grappler arm assembly 144 to move the assembly 144 away from the mold and thus finally compressing the two mold plates together. The movement of piston 151 is very small, usually not discernible when viewing the casting machine from the side, although it may be seen by viewing the cylinder-piston combination. Hydraulic hoses 152 and 153 connect with cylinder 150 to the hydraulic fluid to actuate the piston 151.

The combination of the three hydraulic system enables the mold to be made totally leak free.

Mold backing plate 132 strengthening metal strengthing webs 136 joining its surface away from the mold. These metal strengthening webs provide support to resist warpage of mold backing plate 132 which might be transmitted to mold plate 131. Webs 136 emanate spoke-like from a center point to the back of plate 132 to which they are welded. They also extend to the base 100. Final securing hydraulic cylinder 150 attaches at its end opposite piston 151 to the center point of metal strengthening webs 136.

Grappler arms 142 are pivoted about bifurcated portion 147 of grappler arm assembly 144 at the aforementioned pivot point 143.

Attached to mold backing plate 132 from the side opposite the mold plate 131 are a plurality of hoses 137 attached in the proximity to holes which have been drilled in mold backing plate 132. These holes permit spraying of an air-water mixture upon the back side of mold plate 131 in order that the temperature of the mold plate may be kept relatively constant throughout the casting work day. The hoses 137 which supply the air-water mixture to the mold backing plate 132 are attached (not shown) to hoses 115 which spray the other half of the open faced mold at the other side of the casting machine. The air-water mixture is sprayed upon both mold plates simultaneously.

Situated atop the casting machine is ladle 160 which comprises an elongated cylinder, closed at both ends, from which a 90° elongated pie-shaped wedge has been cut. The ladle receives the lead or lead alloy from the melting pot (not shown), and holds the molten metal until the operator elects to pour it into the mold as described later. Ladle 160 pivots about its center point at each end by axle means 167 which extend from ladle 160 cylindrical ends to cradle 161. Cradle 161 rides on top of the casting machine framework 105 and is moved into place over the mold where the molten metal exits the ladle 160 vertically down into the mold by means of hydraulic cylinder 162 and associated piston 163 attached to cradle 161. In normal operation the ladle is put into position at the start of the operation and left in the position throughout the casting process.

Handle 164 attached to the ladle permits the operator to roll the ladle to permit the molten metal to fall into the mold. The ladle is further described in FIG. 6 where the metal exit openings are shown and described.

Figure 2:
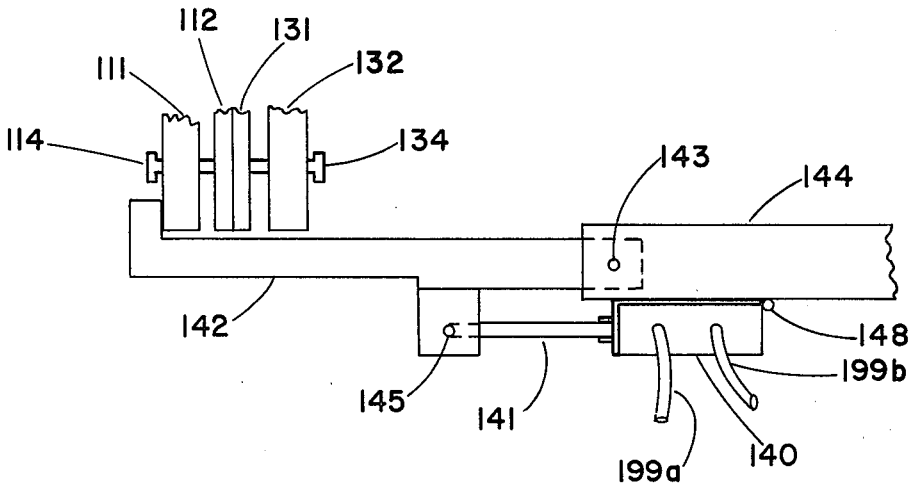
FIG. 2 is a top view of the grappler arms and actuating mechanism.

FIG. 2 is a top view of the grappler arm 142, grappler arm assembly 144, and actuating mechanism which provides the intermediate step in securing the mold plates 112 and 131 together. As shown in FIG. 2, grappler arm 142 is shown in secured position with the L-shaped portion holding mold backing plate 111 which in turn forces mold plate 112 against mold plate 131. Grappler arm 142 swings about pivot point 143 by means of actuating cylinder and piston arrangement 140 and 141 which connects to the grappler arm at point 145. Double acting cylinder 140 is permitted freedom to swing about pivot point 148 when actuating the grappler arm 142. Pivot point 143 about which grappler arm 142 swings and pivot point 148 which permits cylinder 140 to move in short arc distance are attached to grappler arm assembly 144 as shown. Hydraulic fluid supply hoses 199*a* and 199*b* attached to cylinder 140 are illustrated.

In operation, after the main cylinder piston arrangement 101 and 102 have forced the mold plates, together, hydraulic system double acting cylinder and piston 140 and 141 is extended to its farthest position which positions the L-shaped portion of grappler arm 142 around mold backing plate 111. Then, as previously explained, hydraulic cylinder-piston mechanism 150 and 151 (not shown) perform the final securing operation by drawing grappler arm assembly 144 to the rear exerting pressure on mold backing plate 111 and consequently mold plates 112 and 131 to a liquid tight configuration. After the lead alloy is poured into the plenum between mold plates 112 and 113, the air-water mixture cooling applied, and the anode has satisfactorily solidified, pressure is released from cylinder 150 and piston 151 driven back into cylinder 150 to release force applied to the mold plates. Hydraulic pressure is then applied to the opposite side of double acting piston 141 in cylinder 140 to disengage grappler arm 142 from its position securing mold backing plate 111. Grappler arm 142 swings out and away from the mold backing plate 111. Thereafter the molds are separated by main cylinder piston arrangement 101 and 102 and the cast anode removed by mechanical means (not shown).

Figure 3:
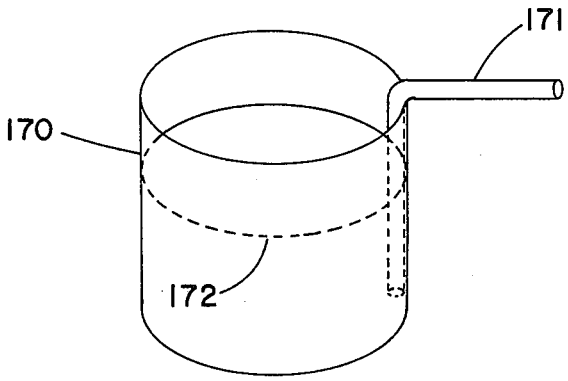
FIG. 3 is a perspective view of the melting pot and transferring tube.

FIG. 3 is a perspective drawing of the melting pot in which the lead and/or lead alloy is fused. Pot 170 is of the type well known in the industry and may be heated by electrical, natural gas, or other means. It may be an open top or closed top pot. In the event pot 170 is heated by an open flame, it is preferred that the top be closed, or in the alternative, that the molten metal be protected from the flames and carbon or other fuels present in the flames by, among other means, placing charcoal upon the surface of the metal. Pouring tube 171 is shown extending exteriorly from melting pot 170 and, by means of dash lines, shown extending down into pot 170 below the surface 172 of the metal inside. Thus when the pot is poured the molten metal will be drawn from the lower portion of the pot through the pouring tube and into the ladle 160 shown in FIG. 1. Pot 170 is situated adjacent to the casting machine shown in FIG. 1 in an elevated position such that pouring tube 171 extends slightly into the cavity of ladle 160 when poured.

Figure 4:
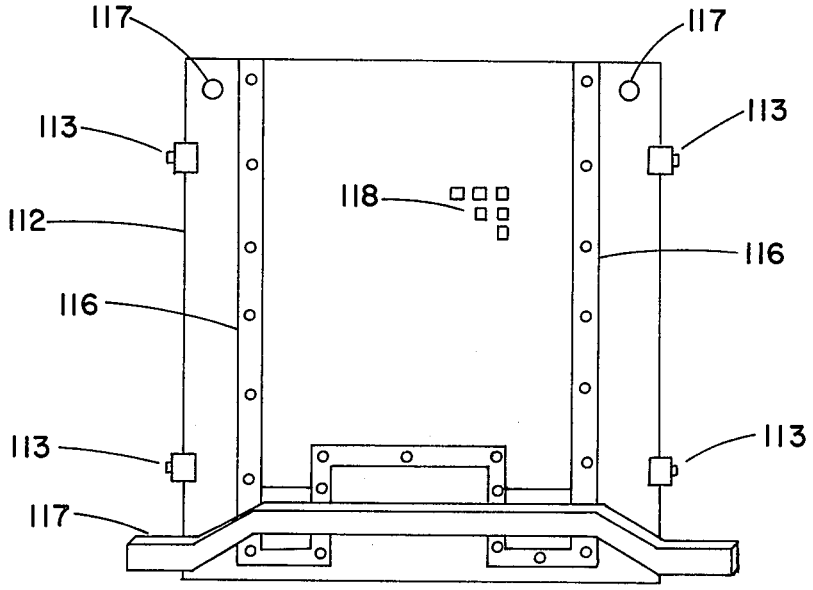
FIG. 4 is a front view of the mold face.

FIG. 4 is a front view of the mold plate 112 and the four L-shaped metal holders 113 securing mold plate 112 to the mold backing plate 111 (not shown). The shape of the mold which determines the cast anode is outlined by steel runners 116 which are beveled slightly on the interior portion to enhance removal of the cast anode from the mold. Hanger bar 117 which, in the typical case, is an elongated bar of copper formed in an arcuate shape about which the metal is cast. Hanger bar 117 is initially placed on the mold plate 112 prior to both mold faces coming together. The purpose of the hanger bar is to provide mechanical and electrical connection with the anode and to that end, the lead and/or lead alloy completely surrounds the bar at at least two points. The anode which is cast from the mold plate illustrated in FIG. 4 is cast upside down, the hanger bar being upright when the anode is used in the electrowinning process. Mold plate 112 must be hollowed out proximate hanger bar 117 in order to allow the lead to surround the bar. Anodes can be made without the hanger bar cast in them and in this case, the steel liners 116 would not be interrupted, but would be complete. It is noted the liners 116 are open at the top to allow entrance of the lead. The anode bottom must then be cut to size.

In an alternate embodiment of the anode casting molds, it may be desirable that there be located either square or circle openings through the anode to permit greater surface exposure to the electrolyte. In such a case, the mold plate shown in FIG. 4 has dispersed throughout its face metal mounds, a few of which are shown on mold plate 112 as number 118. These mounds are either square or circular as desired and, like the steel liners 116, are beveled in such a manner that they taper to the form of a frustrum having the smallest area at the point most distal the face of the mold plate. This enhances easy removal of the anodes from the molds. The mounds 118 are of the same heighth as the mold liners 116, and meet with similar mounds on the other mold plate which are lined in a mirror type arrangement. Similarly, mold plate 131 has liners which meet and mate with liner 116 of mold plate 112. The metal mounds 118 are arranged in vertical and horizontal columns and rows.

Figure 5:
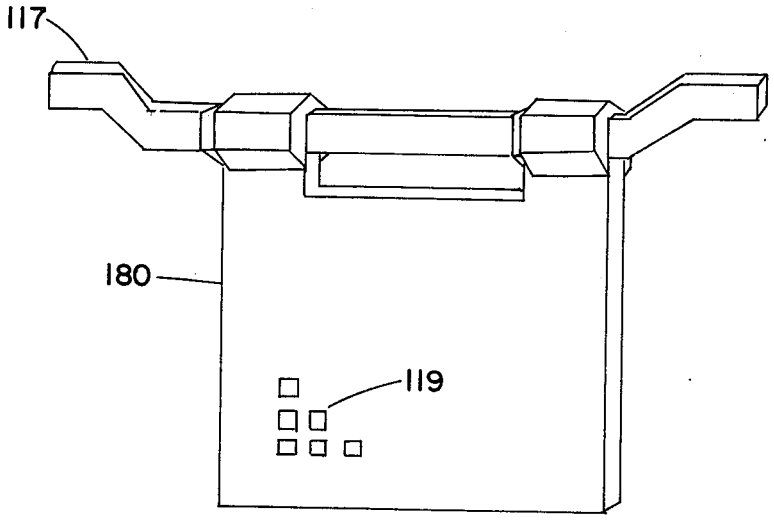
FIG. 5 is a perspective view of an anode cast by the inventive process.

FIG. 5 is a drawing of anode 180 as cast by the subject inventive casting machine. Nominally, these anodes are about 2½ feet wide, 3½ feet long and about ⅜ to ⅝ in. thick. Perforations or openings 119 are shown in FIG. 5 representing a portion of the total number that may be placed in the anode if same is desired. It is noted that these openings are placed in horizontal rows and vertical columns. Hanger bar 117 is shown cast in anode 180.

Figure 6:
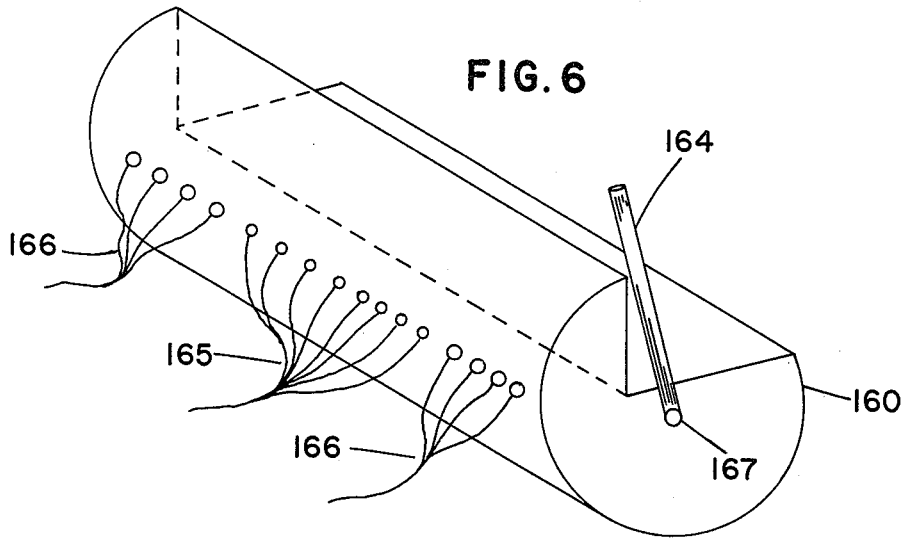
FIG. 6 is a perspective view of the ladle.

FIG. 6 is a perspective view of ladle 160 showing the lead and/or lead alloy exiting openings which permit the molten metal to fall into the mold when the mold is prepared. As can be seen from FIG. 6 the orfices or openings from which the lead exits ladle 160 are of different size, there being smaller holes 165 in the center and larger holes 166 at the outer portions. The reason the sizes of these holes are different may be seen by looking at the anode that is cast illustrated by FIG. 5. As can be seen, there is more lead present at the outer portions of the anode and less lead present in the inner portions of the anode cast. Thus inner holes 165 have less lead to pass into the mold to cast the anode. It is the intent of having the different sized holes in the ladle and to have the holes in alignment with the opening to the mold in order that a dense casting with low porosity be achieved by reducing transfer of the metal from one portion of the mold to another portion by flow across the surface of the molten metal. It is desired that the lead or lead alloy should rise in the mold such that its surface is continuous and, as much as possible, straight across. This is especially true as the molten metal fills to the top of the mold interior. It is noted that in the casting machine shown and described, it is very important that the mold be held in vertical alignment so that as the lead and/or lead alloy falls from ladle 160, it falls to the bottom portion of the mold without striking the sides of the mold. When it is desired to cast an anode which has perforations or openings therethrough, and thus mounds in the mold, the perforations or openings must be in vertical and horizontal alignment. The openings through ladle 160 are aligned such that the lead drops into the molds between the columns of mounds which are in the mold cavity. Again different sized holes or openings in ladle 160 supply different amounts of metal into the different portions of the mold cavity. Handle 164 is shown attached to ladle 160 which permits the operator to roll the ladle 160 upon its lengthwise pivot points 167. A stop (not shown) is provided for handle 164 so that when the ladle is rotated, it rotates and stops at a point directly over the mold cavity. The ladle is rotated in a rapid movement to its stop and it is found that when doing so, the molten metal residing in the ladle does not rotate, but its surface stays relatively horizontal. When the casting operation is completed i.e., the molten metal has risen to the top of the mold cavity the ladle is rotated back to its initial position and recharged with lead and/or lead alloys for the next cast. It is noted that under some circumstances, for example in casting lead-calcium anodes, it is necessary and advisable to cover the surface of the molten metal with powdered and grandular charcoal, or other substances which prevent the calcium from oxidizing in order to retain the calcium in solution.

Figure 7:
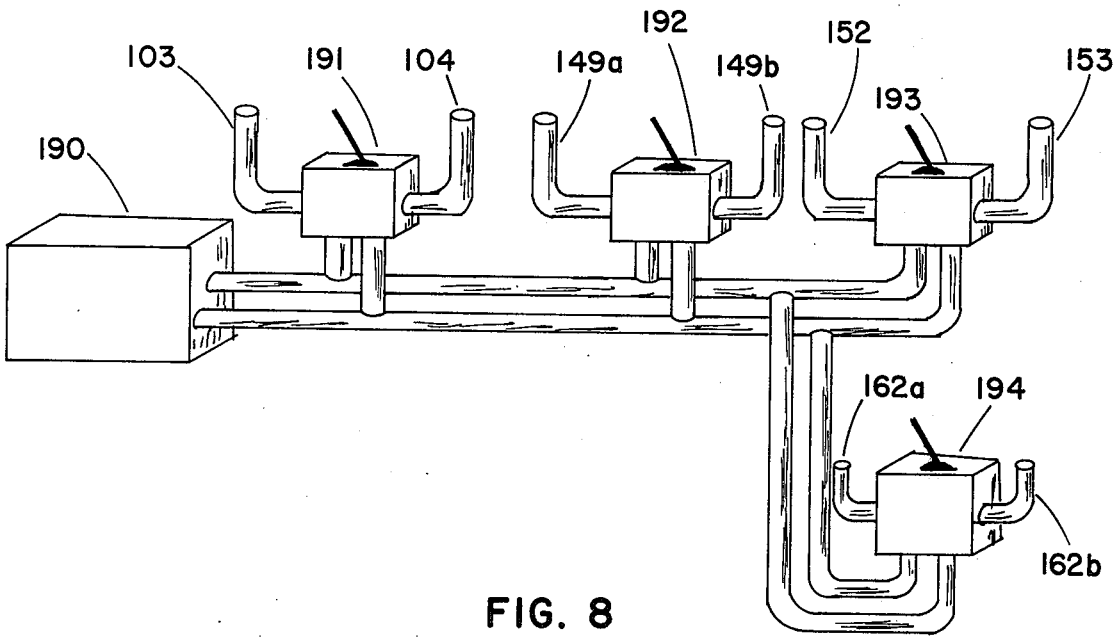
FIG. 7 is a schematic drawing of the hydraulic system.

FIG. 7 is a schematic drawing of the hydraulic system showing the switching means connecting the primary hydraulic pump 190 and the manually operated hydraulic switches 191 operating the engaging hydraulic cylinder-piston arrangement 101 and 102 (not shown) by means of hydraulic hoses 103 and 104; similarly manually operated hydraulic switch 192 supplies hydraulic fluid by means of lines 149*a* and 149*b* to grappler arm actuating cylinder-piston arrangement 140 and 141; manually operated hydraulic switch 193 controlling the operation of final securing cylinder-piston arrangement 150 and 151 through hydraulic hoses 152 and 153; and manually operated hydraulic switch 194 to control the movement of ladle cradle 161 through means of hydraulic hoses 162*a* and 162*b* operably connected to cylinder-piston arrangement 162 and 163.

Figure 8:
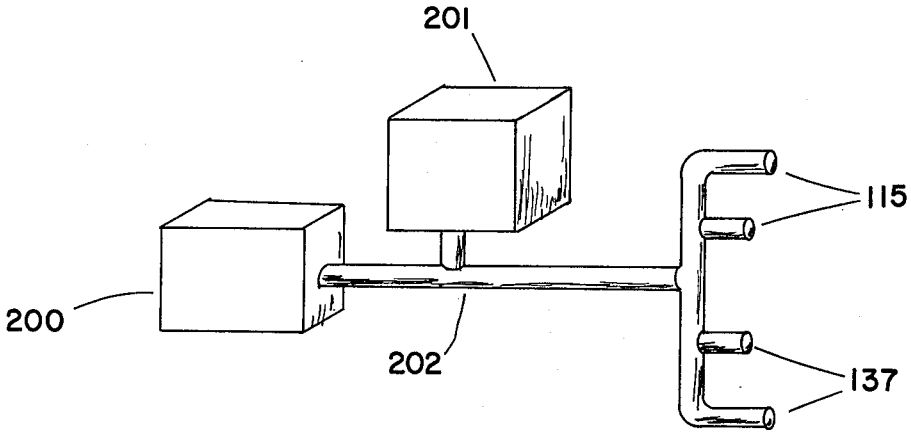
FIG. 8 is a schematic drawing of the air-water cooling system.

FIG. 8 shows the mechanism for supplying the air-water mixture to the mold backing plates 111 and 132 illustrating air pump 200, water container 201 and connecting pipeway 202 which connects with hoses 115 and 137.

By means of the above described casting machine, and the process of casting metal herein described, it is possible to produce very high quality lead and/or lead alloy anodes for use in the copper electrowinning process. The lead anodes, when produced in the above machine, and according to the process here outlined are anodes with very high density, approaching the theoretical absolute density for the metal, and have a surface, which in the case of lead and lead alloys, give the appearance of being rolled, or having the appearance of galvanized metal.

While a preferred embodiment has been shown and described, it will be understood that there is no intent to limit the invention by such disclosure, for example, metals other than lead or lead alloys may be cast, rather, it is intended to cover all modification in alternate construction falling within the spirit and the scope of the invention as defined in the appended claims.

What is claimed is:

1. An anode casting machine for casting metal anodes comprising a base means, a first open faced mold plate, a first backing plate operably connected to said first open faced mold plate, a second open faced mold plate, a second backing plate operably connected to said second open faced mold plate, means attached to said base means to unite and secure said first and second open faced mold plates into a mold configuration, ladle means for introducing molten metal into said mold formed by said first and second mold plates, means to stabilize temperature of said first and second mold plates, means for separating said first and second mold plates and means for transferring molten metal from an associated melting pot to said ladle means, said ladle means for introducing molten metal into said mold configuration comprising rotatable cylinder means having axle means at each end, said axle means operably connected to support means connected to said base means, said cylinder having openings along the circumference and parallel with the longitudinal axis cylinder, whereby said cylinder when filled with molten metal may be rotated until said molten metal pours from said openings.

2. The anode casting machine as defined in claim 1 wherein said means for transferring molten metal from the associated metal pot to said ladle means comprises a transferring tube extending beneath the surface of the molten metal in the associated melting pot to said ladle means, said melting pot in a superior position to said ladle means wherein when said melting pot is tipped, molten metal will transfer to said ladle means.

3. The anode casting machine as defined in claim 1 wherein said ladle means support means is operably connected to the fourth hydraulic means whereby said ladle means is moved into position to pour molten metal into said mold configuration.

4. An anode casting machine as defined in claim 3 wherein the openings in said ladle means comprise a plurality of different sized openings through said cylinder.

5. The anode casting machine as defined in claim 4 wherein said plurality of different sized openings in said ladle means are aligned with said mounds attached to said mold plates such that molten metal pouring from said openings into said mold configuration will drop between vertically aligned columns of said mounds.

6. The anode casting machine as defined in claim 5 wherein the size of the openings in said ladle means is dependent upon the amount of molten metal required to fill that portion of the mold configuration directly below said openings wherein a larger opening is defined where more molten metal is required to fill said portion of said mold cavity.

7. An anode casting machine for casting metal anodes comprising a base means, a first open faced mold plate, a first backing plate operably connected to said first open faced mold plate, a second open faced mold plate, a second backing plate operably connected to said second open faced mold plate, means attached to said base means to unite and secure said first and second open faced mold plates into a mold configuration, ladle means for introducing molten metal into said mold formed by said first and second mold plates, means to stabilize temperature of said first and second mold plates, means for separating said first and second mold plates and means for transferring molten metal from an associated melting pot to said ladle means, said means to unite and secure said first and second open faced mold plates into a mold configuration comprising a first hydraulic means operably connected to said first backing plate whereby said first mold plate operably connected to said first backing plate may be forced against said second mold plate to form a mold configuration to receive molten metal, said means to unite and secure said first and second mold plates into a mold configuration further comprising a second hydraulic means, said second hydraulic means being operably connected to said second backing plate and to grappler arm means, said grappler arm means holding said first backing plate wherein said second hydraulic means further compresses said first mold plate against said second mold plate to provide a liquid tight mold configuration, and wherein said first backing plate operably connected to said first open faced mold plate comprises a flat surface proximate said first mold plate and a plurality of strengthing webs attached to the opposite side of said backing plate, said strengthening webs emanating from a center point in spoke-like fashion to said first backing plate.

8. The anode casting machine as defined in claim 7 wherein said grappler arm means comprises a grappler arm with finger extending at right angles therefrom and grappler arm assembly, said grappler arm in pivot relationship as to said grappler arm assembly, a third hydraulic means attached to said grappler arm and said grappler arm assembly whereby said third hydraulic means may move said grappler arm in an arc and place said grappler arm finger upon said first backing plate surface.

9. The anode casting machine as defined in claim 8 wherein said means for separating said first and second mold plate comprises said second hydraulic means attached to said second backing plate strengthening webs and said grappler arm means, said third hydraulic system operably connected to said grappler arm and grappler arm assembly, and said first hydraulic means operably connected to said first backing plate wherein said second hydraulic means removes said force from the back of said first backing plate, said third hydraulic means removes said grappler arm from said first backing plate, and said first hydraulic means separates said first and second mold plates in order that the cast anode may be removed.

10. An anode casting machine for casting metal anodes comprising a base means, a first open faced mold plate, a first backing plate operably connected to said first open faced mold plate, a second open faced mold plate, a second backing plate operably connected to said second open faced mold plate, means attached to said base means to unite and secure said first and second open faced mold plates into a mold configuration, ladle means for introducing molten metal into said mold formed by said first and second mold plates, means to stabilize temperature of said first and second mold plates, means for separating said first and second mold plates, and means for transferring molten metal from an associated melting pot to said ladle means, said first open face mold plate having a flat surface and comprising a plurality of liners attached to said surface defining the shape of the anode to be cast and having an opening therein, said liners having a beveled edge upon the side defining the shape of the anodes and alignment openings through said plate, said first backing plate having a flat surface proximate said first mold plate and comprising a plurality of strengthening webs attached to said opposite side of said backing plate, said strengthening webs emanating from a center point in spoke-like fashion to said first backing plate, a first plurality of openings through said backing plate, a plurality of jack screws engaged within said first plurality of openings, a plurality of brackets attached to edge portions of said backing plate extending perpendicularly to said backing plate and holding said first open faced mold plate whereby said jack screws press against said first open faced mold plate.

11. An anode casting machine as defined in claim 10 wherein said backing plate has a second plurality of openings therethrough and a plurality of flexible hoses attached to said backing plate encompassing said second plurality of openings whereby an air-water mixture may be sprayed upon said open faced mold plate through said hoses.

12. An anode casting machine for casting metal anodes comprising a base means, a first open faced mold plate, a first backing plate operably connected to said first open faced mold plate, a second open faced mold plate, a second backing plate operably connected to said second open faced mold plate, means attached to said base means to unite and secure said first and second open faced mold plates into a mold configuration, ladle means for introducing molten metal into said mold formed by said first and second mold plates, means to stabilize temperature of said first and second mold plates, means for separating said first and second mold plates, and means for transferring molten metal from an associated melting pot to said ladle means, said first open faced mold plate having a flat surface and comprising a plurality of liners attached to said surface defining the shape of the anode to be cast and having an opening therein, said liners having a beveled edge upon the side defining the shape of the anode and alignment means formed by said plate, said first open faced mold plate also comprising a plurality of mounds having a base attached to said plate surface and protruding therefrom, said mounds interior to said shape defined by said liners and said mounds having a beveled edge whereby the base of said mounds is of greater area than the top of said mounds, said first open faced mold plate liners being interrupted to accomodate a hanger bar, said plate surface having a hollowed out portion in proximity to said interruptions within the shape defined by said liners whereby said molten metal may flow and surround an associated hanger bar.

13. The anode casting machine as defined in claim 1 wherein said liners heighth and mound heighth is one-half the thickness of the anode to be cast.

14. The anode casting machine as defined in claim 1 wherein said first backing plate operably connected to said first open faced mold plate comprises a flat surface proximate said first mold plate, a plurality of strengthening webs attached to said opposite side of said backing plate, said strengthening webs emanating from a center point in spoke-like fashion to said first backing plate, a first plurality of openings through said backing plate, a plurality of jack screws screwed through said first plurality of openings, a plurality of brackets attached to edge portions of said backing plate extending perpendicularly to said backing plate and holding said first open faced mold plate whereby said jack screws press against said first open faced mold plate.

15. An anode casting machine as defined in claim 14 wherein said backing plate has a second plurality of openings therethrough and a plurality of flexible hoses attached to said backing plate encompassing said second plurality of openings whereby an air-water mixture may be sprayed upon said open faced mold plate through said hoses.

16. The anode casting machine as defined in claim 15 wherein said second open faced mold plate comprises a flat surface, a plurality of liners attached to said surface defining the shape of the anode to be cast and having an opening therein, said liners having a beveled edge upon the side defining the shape of the anodes, and alignment pin means attached to said plate.

17. The anode casting machine as defined in claim 16 wherein said second open faced mold plate comprises a plurality of mounds having a base attached to said plate surface and protruding therefrom, said mounds interior to said shape defined by said liners, and said mounds having a beveled edge whereby the base of said mounds is of greater area than the top of said mounds.

18. The anode casting machine as defined in claim 17 wherein said second open faced mold plate liners are interrupted in at least two places to accommodate a hanger bar, and said plate surface having a hollowed out portion in proximity said interruptions within the shape defined by said liners whereby said molten metal may flow and surround an associated hanger bar.

19. The anode casting machine as defined in claim 18 wherein said liners heighth and mound heighth is one-half the thickness of the anode to be cast.

20. The anode casting machine as defined in claim 19 wherein said second backing plate operably connected to said second open faced mold plate comprises a flat surface proximate said second mold plate, a plurality of strengthening webs attached to said opposite side of said backing plate and to said base, said strengthening webs emanating from a center point in spoke-like fashion to said first backing plate, a first plurality of openings through said backing plate, a plurality of jack screws screwed through said first plurality of openings, a plurality of brackets attached to edge portion of said backing plate extending perpendicularly to said backing plate and holding said second open faced mold plate whereby said jack screws press against said second open faced mold plate.

21. The anode casting machine as defined in claim 20 wherein said means to unite and secure said first and second open faced mold plate into a mold configuration comprises a first hydraulic means operably connected to said plurality of strengthening webs attached to said first backing plate whereby said first mold plate operably connected to said first backing plate may be forced against said second mold plate to form a mold configuration to receive molten metal.

22. An anode casting machine as defined in claim 21 wherein said means to unite and secure said first and second mold plates into a mold configuration further comprising a second hydraulic means, said second hydraulic means operably connected to said strengthening webs attached to said second backing plate and to grappler arm means, said grappler arm means holding said first backing plate wherein said second hydraulic means further compresses said first mold plate against said second mold plate to provide a liquid tight mold configuration.

23. The anode casting machine as defined in claim 22 wherein said grappler arm means comprises a grappler arm with finger extending at right angles therefrom and grappler arm assembly, said grappler arm in pivot relationship as to said grappler arm assembly, a third hydraulic means attached to said grappler arm and said grappler arm assembly whereby said third hydraulic means may move said grappler arm in an arc and place said grappler arm finger upon said first backing plate surface.

24. An anode casting machine for casting metal anodes as defined in claim 23 wherein said ladle means for introducing molten metal into said mold configuration comprises rotatable cylinder means having axle means at each end, said axle means operably connected to support means connected to said base means, said cylinder having openings along the circumference and parallel with the longitudinal axis of said cylinder, whereby said cylinder when filled with molten metal may be rotated until said molten metal pours from said openings.

25. The anode casting machine as defined in claim 24 wherein said ladle means support means is operably connected to the fourth hydraulic means whereby said ladle means is moved into position to pour molten metal into said mold configuration.

26. An anode casting machine as defined in claim 25 wherein the openings in said ladle means comprises a plurality of different sized openings through said cylinder.

27. The anode casting machine as defined in claim 26 wherein said plurality of different sized openings in said ladle means are aligned with said mounds attached to said mold plates such that molten metal pouring from said openings into said mold configuration will drop between vertically aligned columns of said mounds.

28. The anode casting machine as defined in claim 27 wherein the size of the openings in said ladle means is dependent upon the amount of molten metal required to fill that portion of the mold configuration directly below said opening wherein a larger opening is defined where more molten metal is required to fill said portion of said mold cavity.

29. The anode casting machine as defined in claim 28 wherein said means for separating said first and second mold plate comprises said second hydraulic means attached to said second backing plate strengthening webs and said grappler arm means, said third hydraulic system operably connected to said grappler arm and grappler arm assembly, and said first hydraulic means operably connected to said first backing plate wherein said second hydraulic means removes said force from the back of said first backing plate, said third hydraulic means removes said grappler arm from said first backing plate, and said first hydraulic means separates said first and second mold plates in order that the cast anode may be removed.

30. The anode casting machine as defined in claim 29 wherein said means for transferring molten metal from the associated metal pot to said ladle means comprises a transferring tube extending beneath the surface of the molten metal in the associated melting pot to said ladle means, said melting pot in a superior position to said ladle means wherein when said melting pot is tipped, molten metal will transfer to said ladle means.

31. The anode casting machine as defined in claim 30 wherein said metal may be lead or lead based alloys.

* * * * *